US008519818B2

(12) United States Patent
Chen et al.

(10) Patent No.: US 8,519,818 B2
(45) Date of Patent: Aug. 27, 2013

(54) METALLIC SILICIDE RESISTIVE THERMAL SENSOR AND METHOD FOR MANUFACTURING THE SAME

(75) Inventors: Chung-Nan Chen, New Taipei (TW); Chien-Hua Hsiao, Kaohsiung (TW); Wen-Chie Huang, Hualien County (TW)

(73) Assignee: National Kaohsiung University of Applied Sciences, Kaohsiung (TW)

( * ) Notice: Subject to any disclaimer, the term of this patent is extended or adjusted under 35 U.S.C. 154(b) by 0 days.

(21) Appl. No.: 13/532,921

(22) Filed: Jun. 26, 2012

(65) Prior Publication Data

US 2013/0181808 A1 Jul. 18, 2013

(30) Foreign Application Priority Data

Jan. 13, 2012 (TW) ..... 101101317 A

(51) Int. Cl.
*H01C 7/10* (2006.01)

(52) U.S. Cl.
USPC ..... 338/22 SD; 338/13; 338/7

(58) Field of Classification Search
USPC ..... 338/22 SD
See application file for complete search history.

(56) References Cited

U.S. PATENT DOCUMENTS

| | | | | |
|---|---|---|---|---|
| 5,300,915 | A * | 4/1994 | Higashi et al. | 338/22 R |
| 5,600,174 | A * | 2/1997 | Reay et al. | 257/467 |
| 5,939,971 | A * | 8/1999 | Yong | 338/15 |
| 6,137,107 | A * | 10/2000 | Hanson et al. | 250/332 |
| 6,225,629 | B1 * | 5/2001 | Ju | 250/338.1 |
| 7,002,153 | B1 * | 2/2006 | Gillham et al. | 250/338.1 |

* cited by examiner

*Primary Examiner* — Kyung Lee
(74) *Attorney, Agent, or Firm* — Bacon & Thomas, PLLC

(57) ABSTRACT

A metallic silicide resistive thermal sensor has a body, a conductive wire and multiple electrodes. The body has multiple etching windows formed on the body and a cavity formed under the etching windows. The etching windows separate the body into a suspended part and multiple connection parts. The conductive wire is formed on the suspended part and the connection parts and is made of metallic silicide. The electrodes are formed on the body and are electrically connected to the conductive wire. The metallic silicide is compatible for common CMOS manufacturing processes. The cost for manufacturing the resistive thermal sensor decreases. The metallic silicon is stable at high temperature. Therefore, the performance of the resistive thermal sensor in accordance with the present invention is improved.

20 Claims, 18 Drawing Sheets

METALLIC SILICIDE RESISTIVE THERMAL SENSOR AND METHOD FOR MANUFACTURING THE SAME

BACKGROUND OF THE INVENTION

1. Field of the Invention

The present invention relates to a resistive thermal sensor and method for manufacturing the same, and more particularity to a metallic silicide resistive thermal sensor and method for manufacturing the same.

2. Description of Related Art

A resistive thermal sensor is a device that converts a heat signal into an electrical signal induced by the change of resistance of the device. The applications of the resistive thermal sensor relate to microbolometer infrared sensors, pressure sensors, flowmeters, thermal accelerometers, etc.

For example, the microbolometer infrared sensors manufactured by Honeywell Inc./U.S. and LETI Inc./France are composed of vanadium oxide and amorphous silicon. However, such materials are not compatible for common CMOS manufacturing process. Additional manufacturing processes and equipments are necessary to form such vanadium oxide and amorphous silicon. Therefore, semiconductor manufactories hardly fabricate the microbolometers with such materials at low price. As a result, the cost for manufacturing the microbolometers rises. Moreover, flicker noises generated from such semiconductor materials are higher than those generated from the metallic materials when the microbolometers are activated.

With reference to U.S. Pat. No. 5,698,852, a titanium bolometer-type infrared detecting apparatus is disclosed. The bolometer takes titanium as a conducting medium and the titanium is compatible for common CMOS manufacturing process. However, the low temperature coefficient of resistance (TCR) of titanium is only 0.25%/K and will result in low sensitivity. In addition, the stability of titanium is poorer than that of metallic silicide in high temperature semiconductor processes.

SUMMARY OF THE INVENTION

An objective of the present invention is to provide a metallic silicide resistive thermal sensor and method for manufacturing the same. The resistive thermal sensor is compatible for common CMOS manufacturing process. The noises of the resistive thermal sensor in accordance with the present invention are lower than those of semiconductor materials, and the temperature coefficient of resistance of the metallic silicide is higher than that of CMOS compatible titanium film.

The resistive thermal sensor in accordance with the present invention comprises a body, multiple electrodes and a conductive wire.

The body comprises a central region, a surrounding region, multiple etching windows formed on the central region and a cavity formed under the etching windows and the central region and communicating with the etching windows.

The etching windows separate the body into a suspended part and multiple connection parts. The suspended part and the connection parts are formed above the cavity. The multiple connection parts extend from the surrounding region and are connected to the suspended part to support the suspended part above the cavity.

The conductive wire is formed in the suspended part and the connection parts and has multiple ends, wherein the conductive wire in the suspended part is serpentine. The conductive wire is made of metallic silicide.

The electrodes are formed on the body and are electrically and respectively connected to the ends of the conductive wire.

The method for manufacturing the resistive thermal sensor in accordance with the present invention comprises the following steps:

providing a base;

forming a metallic silicide on the base, wherein the metallic silicide is serpentine;

forming a conducting layer on the base and the conducting layer covering and electrically connected to the metallic silicide;

partially removing the conducting layer to maintain a part of the conducting layer to form multiple electrodes electrically connected to the metallic silicide;

forming multiple etching windows on the base, wherein a surrounding region is defined around the etching windows, and the etching windows separate the base into a suspended part and multiple connection parts connected to the suspended part; and forming a cavity under the etching windows, the suspended part and the connection parts, wherein the connection parts extend from the surrounding region and are connected to the suspended part to support the suspended part above the cavity.

The base, such as a monocrystalline silicon substrate or a wafer, and the metallic silicide, such as titanium silicide, cobalt silicide, nickel silicide, tantalum silicide, tungsten silicide and molybdenum silicide, are compatible for common CMOS manufacturing process. Therefore, the cost for manufacturing the resistive thermal sensor in accordance with the present invention decreases. The flicker noises of metallic silicides are much lower than those of semiconductor materials usually used in resistive thermal sensors. The temperature coefficient of resistance of metallic silicide reaches 0.39%/K, which is better than that of the CMOS compatible titanium material in the prior art. Besides, the stability of metallic silicide is higher that that of CMOS metals in high temperature process.

DETAILED DESCRIPTION OF THE PREFERRED EMBODIMENT

Figure 1A:
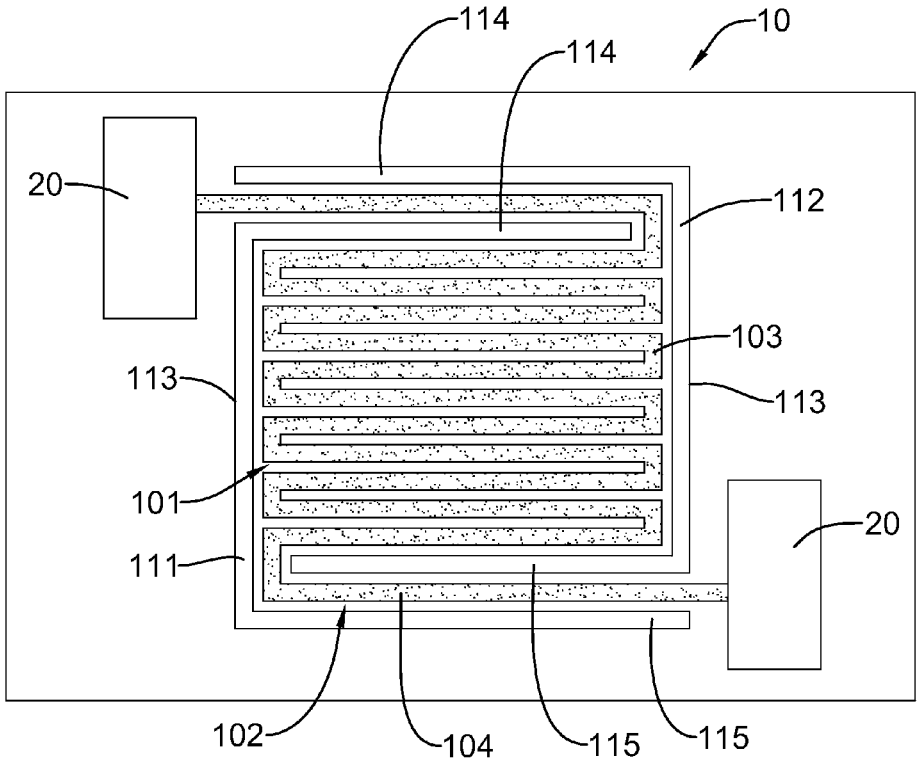
FIG. 1A is a top view of an embodiment in accordance with the present invention.
Figure 2:
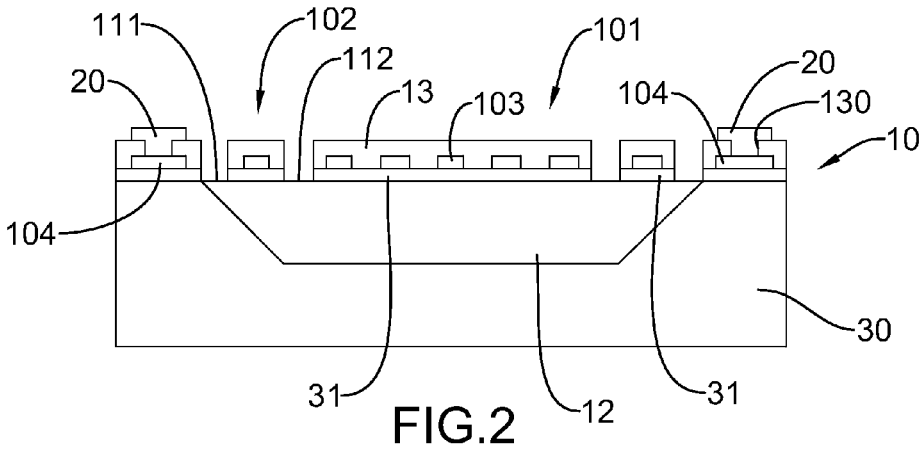
FIG. 2 is a cross-sectional view of a first embodiment in accordance with the present invention.

With reference to FIGS. 1A and 2, a top view and a cross-sectional view of the resistive thermal sensor in accordance with the present invention are disclosed, wherein the structures of both figures are for illustrative purpose only and do not correspond to each other. The resistive thermal sensor in accordance with the present invention comprises a body 10, multiple electrodes 20 and a conductive wire 103.

The body 10 comprises a top surface, a central region, a surrounding region, multiple etching windows 111, 112 and a cavity 12.

The central region and the surrounding region are defined on the top surface of the body 10.

The multiple etching windows 111, 112 are formed on the central region.

The cavity 12 is formed under the etching windows 111, 112 and the central region and communicates with the etching windows 111, 112.

Figure 1B:
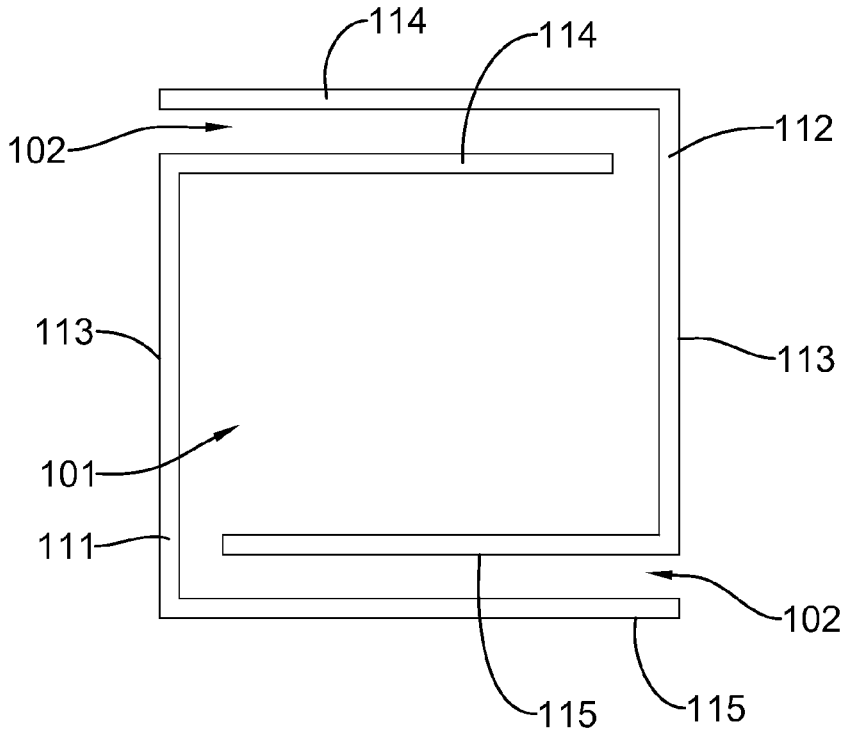
FIG. 1B is a top view of the etching windows of FIG. 1A.

With reference to FIG. 1B, the etching windows 111, 112 separate the central region into a suspended part 101 and multiple connection parts 102. The suspended part 101 and the connection parts 102 are formed above the cavity 12. The connection parts 102 extend from the surrounding region and are respectively connected to the suspended part 101 to support the suspended part 101 above the cavity 12.

The multiple etching windows 111, 112 comprise a first etching window 111 and a second etching window 112. Each etching window 111, 112 has a first groove 113, a second groove 114 and a third groove 115. The first groove 113 has two opposite terminals. The second groove 114 and the third groove 115 respectively extend from the two terminals and the grooves 113-115 form a C shape. The suspended part 101 is enclosed within the first etching window 111 and the second etching window 112. The connection parts 102 are respectively formed between the second grooves 114 of the first etching window 111 and the second etching window 112 and between the third grooves 115 of the first etching window 111 and the second etching window 112.

With reference to FIG. 1A, the conductive wire 103 is formed on the suspended part 101 and the connection parts 102 and has multiple ends 104. The conductive wire 103 is serpentine and made of metallic silicide. A thickness of the conductive wire 103 is between 10 nm and 500 nm, the sheet resistance of the conductive wire 103 is below 20 ohm/sq, and the temperature coefficient of resistance (TCR) of the conductive wire 103 is positive. Such metallic silicide can be titanium silicide ($TiSi_2$), cobalt silicide ($CoSi_2$), nickel silicide ($NiSi_2$), tantalum silicide ($TaSi_2$), tungsten silicide ($WSi_2$), molybdenum silicide ($MoSi_2$), etc.

The electrodes 20 are formed on the top surface of the body 10 and electrically and respectively connected to the ends 104 of the conductive wire 103.

With reference to FIG. 2, the body 10 of a first embodiment in accordance with the present invention comprises a substrate 30 and an insulation layer 31. The substrate 30 can be a <100>-orientated monocrystalline silicon substrate. The insulation layer 31 is formed on the substrate 30. The cavity 12 is formed in the substrate 30. The etching windows 111, 112 are formed in the insulation layer 31. The conductive wire 103 is formed on the insulation layer 31.

In the first embodiment, an outer insulation layer 13 is further formed on the insulation layer 31. The outer insulation layer 13 covers the suspended part 101, the connection parts 102 and the conductive wire 103. The outer insulation layer 13 has multiple holes 130. The holes 130 are opposite to the electrodes 20. The electrodes 20 are formed on the outer insulation layer 13 and respectively extend into the holes 130 to electrically connect to the ends 104 of the conductive wire 103 respectively.

Figure 3:
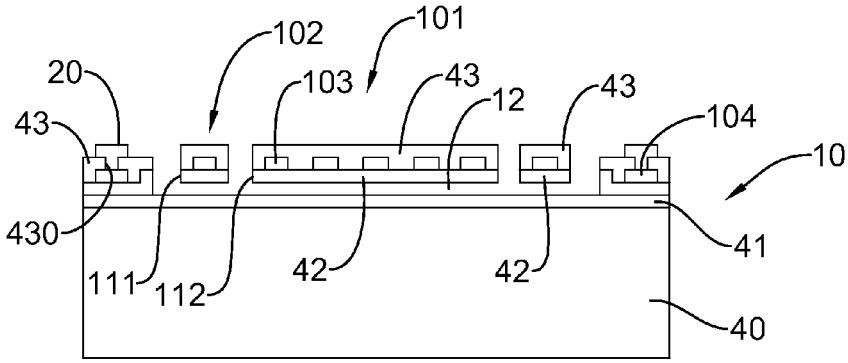
FIG. 3 is a cross-sectional view of a second embodiment in accordance with the present invention.

With reference to FIG. 3, a cross-sectional view of a second embodiment in accordance with the present invention is disclosed. The body 10 comprises a substrate 40, a first insulation layer 41 and a second insulation layer 42. The first insulation layer 41 and the second insulation layer 42 are sequentially formed on the substrate 40. The substrate 40 can be a <100>-orientated monocrystalline silicon substrate. The cavity 12 is formed between the second insulation layer 42 and the first insulation layer 41. The etching windows 111, 112 are formed in the second insulation layer 42. The conductive wire 103 is formed on the second insulation layer 42. An outer insulation layer 43 is further formed on the second insulation layer 42. The outer insulation layer 43 covers the suspended part 101, the connection parts 102 and the conductive wire 103. The outer insulation layer 43 has multiple holes 430. The holes 430 are opposite to the electrodes 20 respectively. The electrodes 20 are formed on the outer insulation layer 43 and respectively extend into the holes 430 to electrically connect to the ends 104 of the conductive wire 103.

Figure 4:
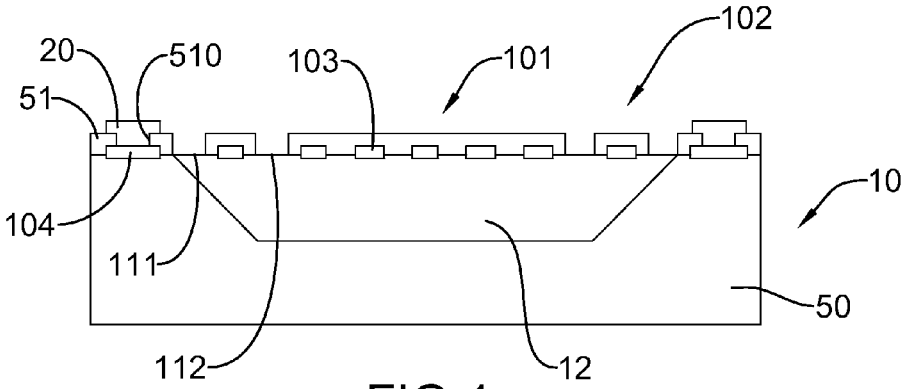
FIG. 4 is a cross-sectional view of a third embodiment in accordance with the present invention.

With reference to FIG. 4, a cross-sectional view of a third embodiment in accordance with the present invention is disclosed. The body 10 is a substrate 50. The substrate 50 can be a <100>-orientated monocrystalline silicon substrate. The etching windows 111, 112 are formed on the substrate 50 and the cavity 12 is formed under the etching windows 111, 112. The suspended part 101 and the connection parts 102 are regarded as the conductive wire 103. An outer insulation layer 51 is further formed on the substrate 50. The outer insulation layer 51 covers the conductive wire 103. The outer insulation layer 51 has multiple holes 510. The holes 510 are opposite to the electrodes 20 respectively. The electrodes 20 are formed on the outer insulation layer 51 and respectively extend into the holes 510 to electrically connect to the ends 104 of the conductive wire 103.

The manufacturing method of the first, the second and the third embodiments are respectively specified below.

Figure 5A:
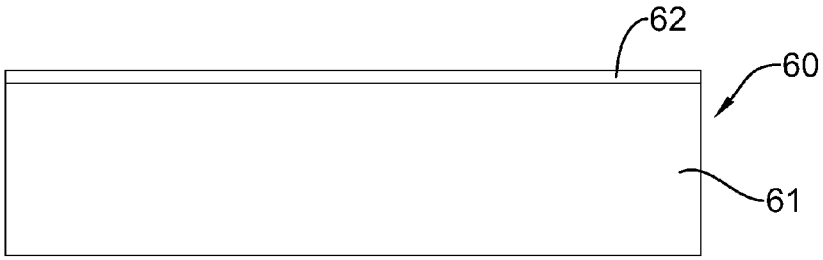
FIGS. 5A-5Q are manufacturing steps of the first embodiment.

In the first embodiment, with reference to FIG. 5A, a first step is to provide a base 60. The base 60 has a substrate 61 and an insulation layer 62 formed on the substrate 60.

A second step is to form a metallic silicide on the base 60, such as on the insulation layer 62. The metallic silicide is manufactured by the following steps.

Figure 5B:
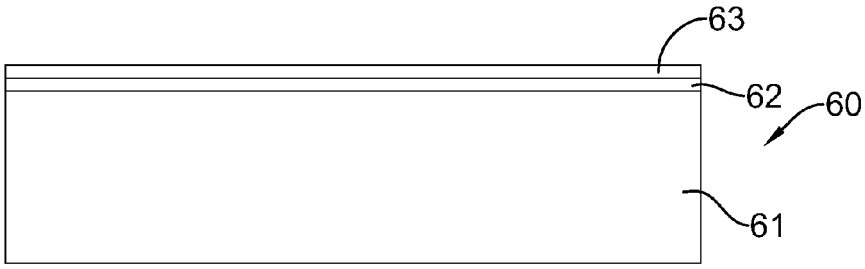
Figure 5C:
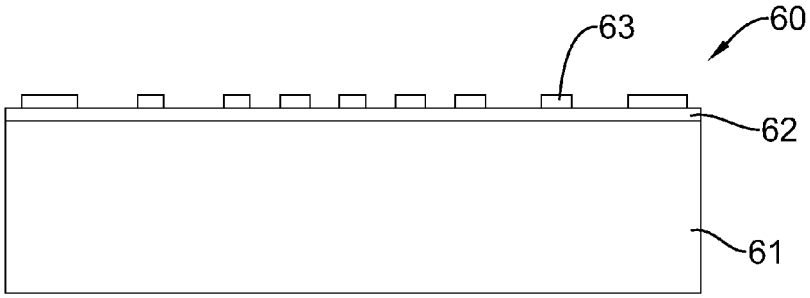
Figure 5D:
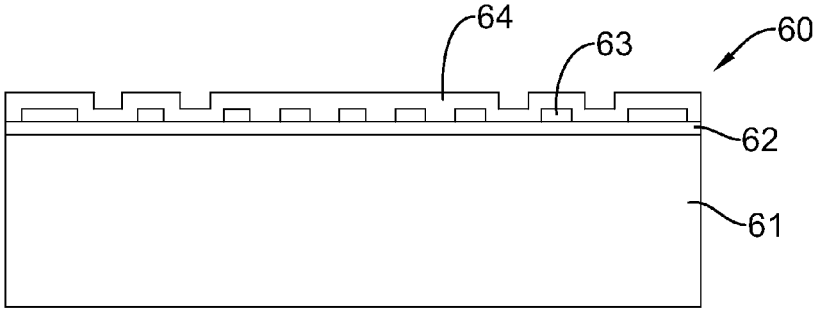
Figure 5E:
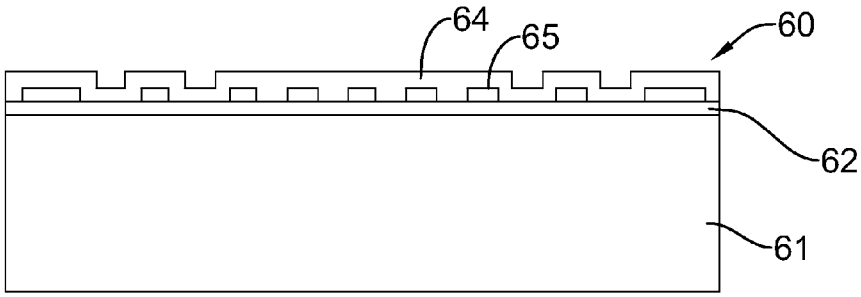
Figure 5F:
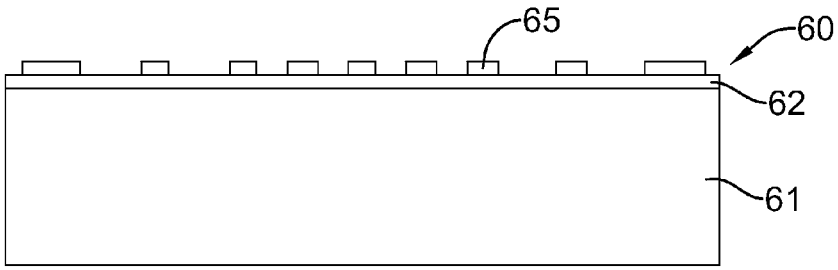

With reference to FIGS. 5B-5F, a first process to form the metallic silicide is disclosed. With reference to FIG. 5B, a beginning step is to form a silicon film 63 on the insulation layer 62. With reference to FIG. 5C, a next step is to make the silicon film 63 serpentine as the conductive wire 103 illustrated in FIG. 1 via a photolithography procedure and an etching procedure. With reference to FIG. 5D, a next step is to form a metal film 64 on the insulation layer 62 to cover the silicon film 63. The metal film 64 can be a titanium (Ti) film, a cobalt (Co) film, a nickel (Ni) film, a tantalum (Ta) film, a tungsten (W) film, a molybdenum (Mo) film, etc. With reference to FIG. 5E, a next step is to anneal the base 60 at an annealing temperature. The annealing temperature approximates to 800° C. The metal elements of the metal film 64 diffuse into the silicon film 63 and then the silicon film 63 turns into a metallic silicide 65. The metallic silicide 65 is regarded as the conductive wire 103 illustrated in FIG. 1. With reference to FIG. 5F, a final step is to partially remove the metal film 64 that has not reacted with the silicon film 63 yet.

Figure 5G:
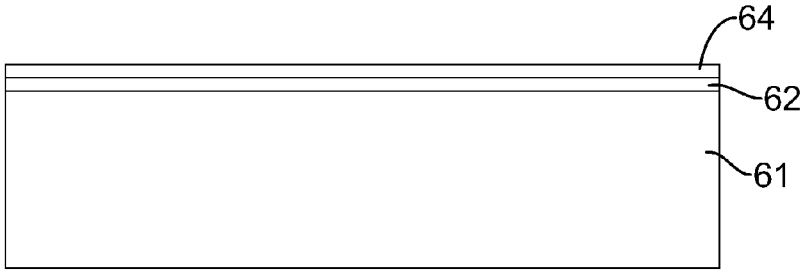
Figure 5H:
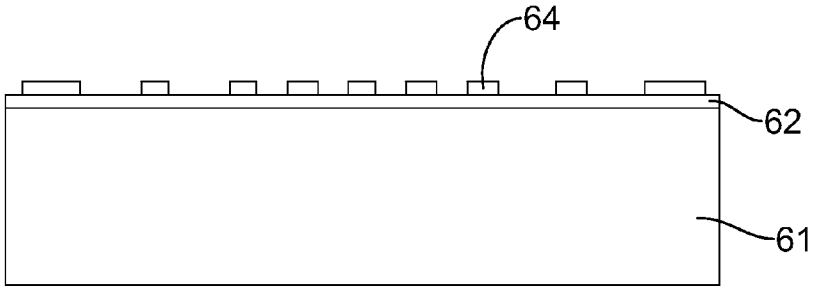
Figure 5I:
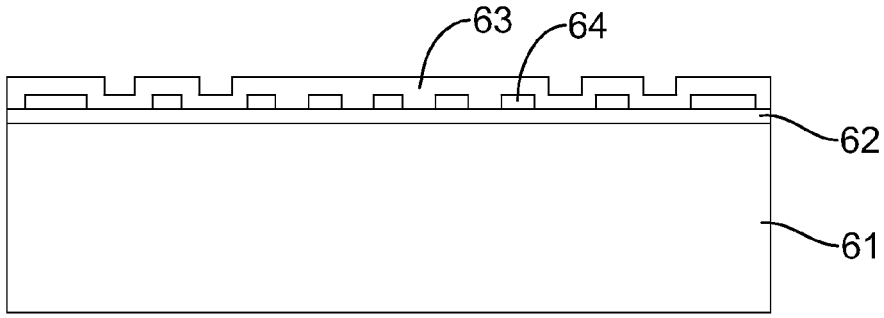
Figure 5J:
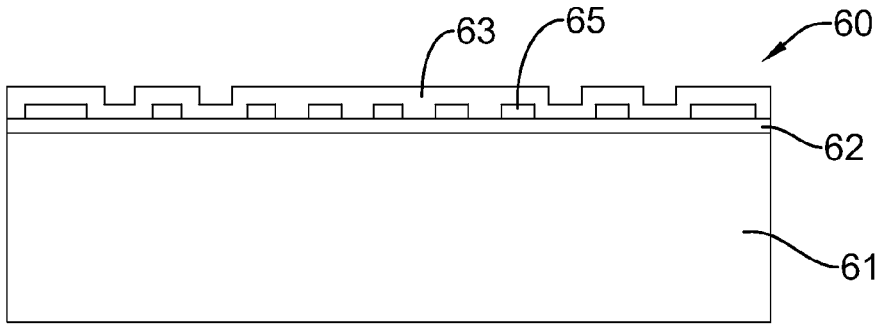

With reference to FIGS. 5G-5J, a second process to form the metallic silicide is disclosed. With reference to FIG. 5G, a beginning step is to form a metal film 64 on the insulation layer 62. With reference to FIG. 5H, a next step is to make the metal film 64 serpentine as the conductive wire 103 illustrated in FIG. 1 via a photolithography procedure and an etching procedure. With reference to FIG. 5I, a next step is to form a silicon film 63 on the insulation layer 62 to cover the metal film 64. With reference to FIG. 5J, a next step is to anneal the base 60 at an annealing temperature. The annealing temperature approximates to 800° C. The silicon elements of the silicon film 63 diffuse into the metal film 64 and then the metal film 64 turns into a metallic silicide 65. The metallic silicide 65 is regarded as the conductive wire 103 illustrated in FIG. 1. A final step is to partially remove the silicon film 63 that has not reacted with the metal film 64 yet.

Figure 5K:
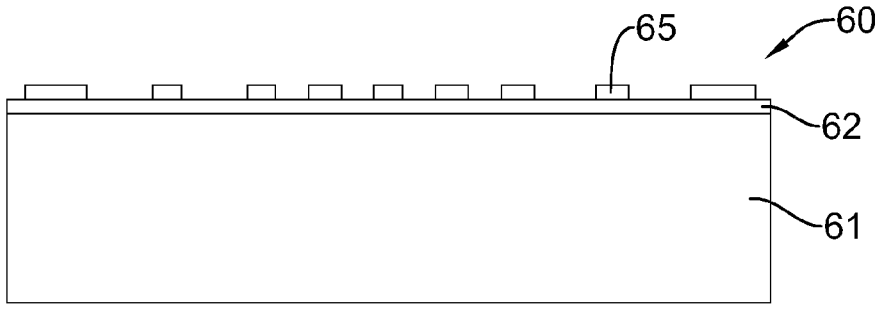

With reference to FIG. 5K, after the metallic silicide 65 is formed, a third step is to anneal the base 60 at an annealing temperature to stabilize the metallic silicide 65 if necessary. The annealing temperature approximates to 800° C.

Figure 5L:
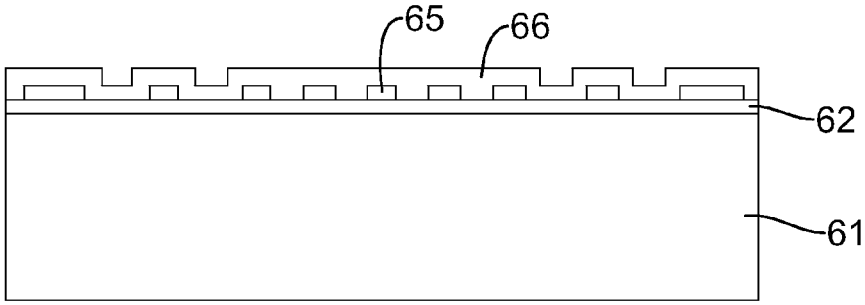

With reference to FIG. 5L, a fourth step is to form an outer insulation layer 66 on the insulation layer 62 to cover the metallic silicide 65.

Figure 5M:
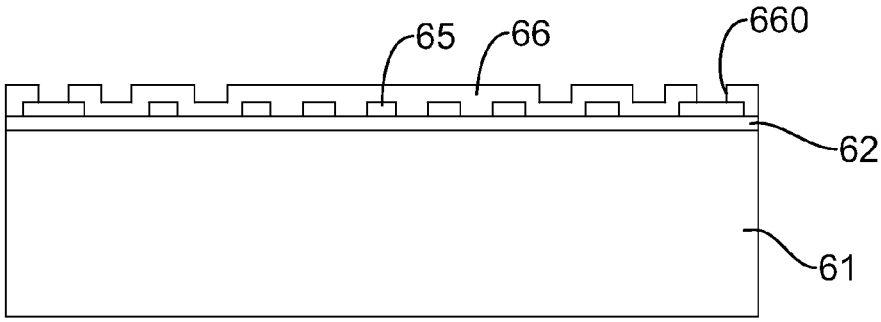

With reference to FIG. 5M, a fifth step is to define multiple electrode formation areas on the outer insulation layer 66 and then to form multiple holes 660 through the outer insulation layer 66 at the electrode formation areas. The metallic silicide 65 is partially exposed in the holes 660.

Figure 5N:
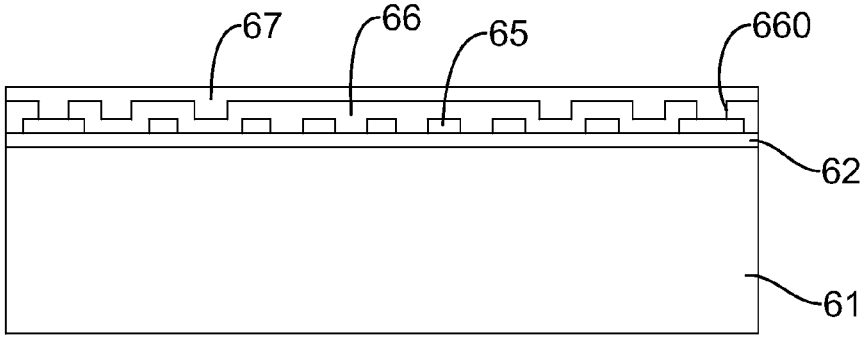

With reference to FIG. 5N, a sixth step is to form a conducting layer 67 on the outer insulation layer 66. The conducting layer 67 extends into the holes 660 to electrically connect to the metallic silicide 65.

The fourth, the fifth and the sixth steps are optional. That means that the conducting layer 67 can be directly formed on the base, wherein the conducting layer 67 covers the metallic silicide 65 and is applied to define the electrode formation areas.

Figure 5O:
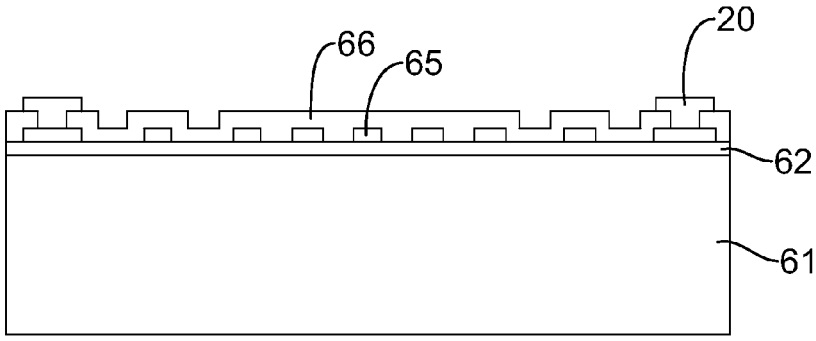

With reference to FIG. 5O, the seventh step is to partially remove the conducting layer to maintain a part of the conducting layer in the electrode formation areas. The remaining conducting layer forms multiple electrodes 20.

Figure 5P:
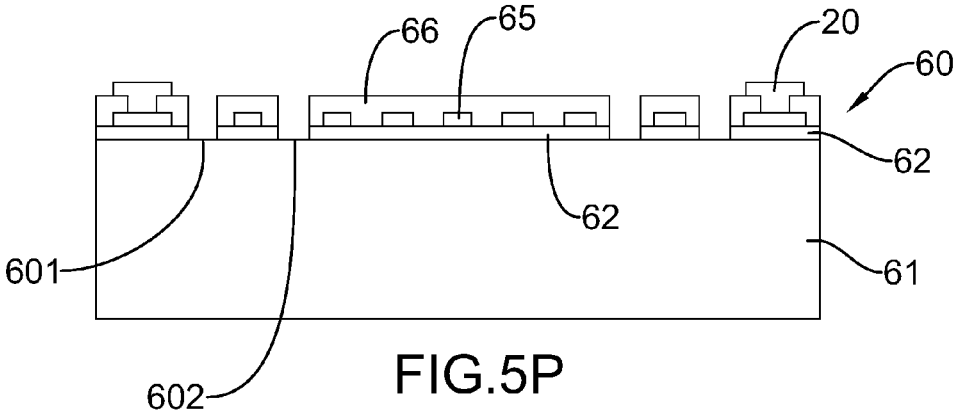

With reference to FIG. 5P, the eighth step is to form multiple etching windows 601, 602 on the base 60. A beginning step is to define a first etching window region and a second etching window region on the base 60. A next step is to partially remove the etching window regions of the outer insulation layer 66 and the insulation layer 62 via a photolithography procedure and an etching procedure to form a first etching window 601 and a second etching region 602. The base 60, such as the substrate 61, is partially exposed in the first etching window 601 and the second etching window 602. A surrounding region is defined around the etching windows 601, 602.

Figure 5Q:
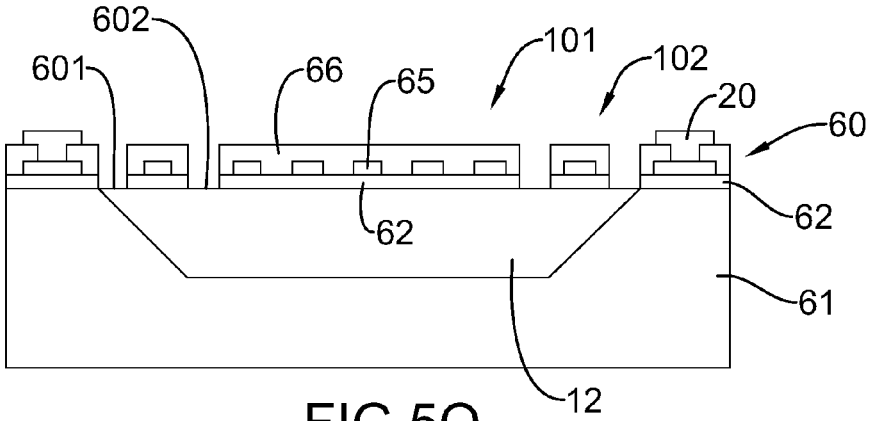

With reference to FIG. 5Q, a ninth step is to etch the base to form a cavity 12. The materials of the insulation layer 62 and the substrate 61 are different, wherein the insulation layer 62 is made of SiO2 and the substrate 61 is a monocrystalline silicon substrate, and the etching rate of the substrate 61 is faster than that of the insulation layer 62. In addition, an etch solution internally etches downward the substrate 61 to form the cavity 12 based on the <100>-oriented characteristic. As a result, such first embodiment is accomplished.

The body mentioned above comprises the substrate 61 and the insulation layer 62. The insulation layer 62 above the cavity 12 form the suspended part 101 and the connection parts 102. The suspended part 101 and the connection parts 102 are above the cavity 12. The connection parts 102 extend from the surrounding region and are respectively connected to the suspended part 101 to support the suspended part 101 above the cavity 12. According to the steps mentioned above, the first embodiment in accordance with the present invention is feasible.

Figure 6A:
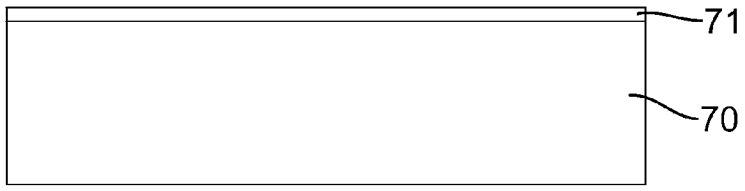
FIGS. 6A-6T are manufacturing steps of the second embodiment.
Figure 6B:
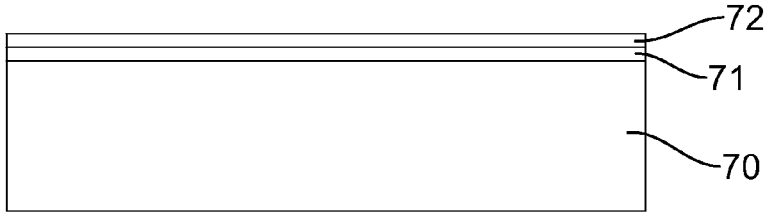
Figure 6C:
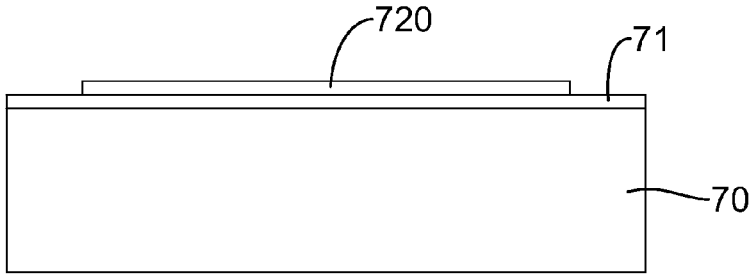
Figure 6D:
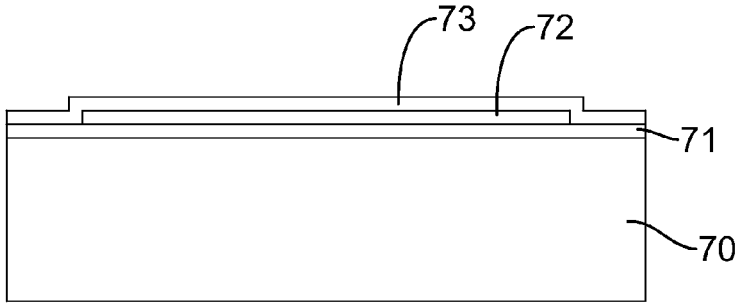
Figure 6E:
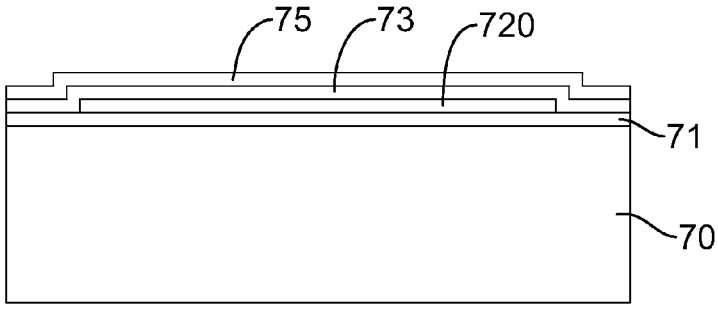
Figure 6F:
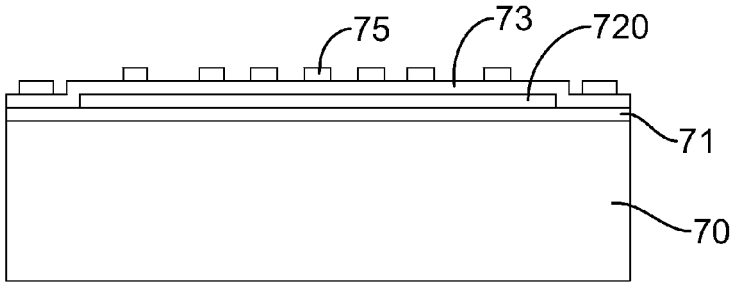
Figure 6G:
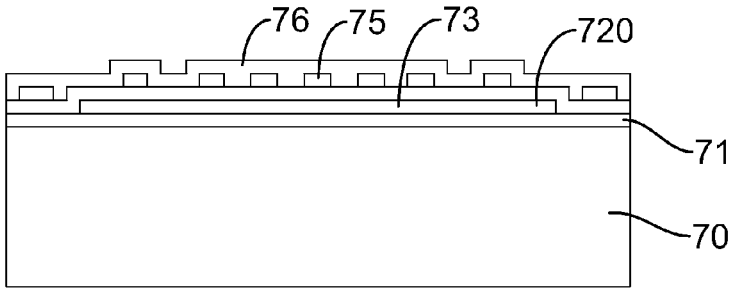
Figure 6H:
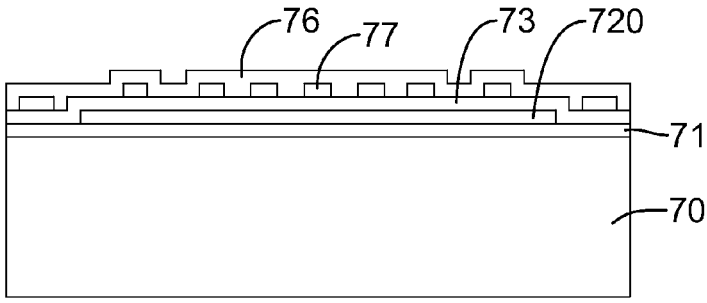
Figure 6I:
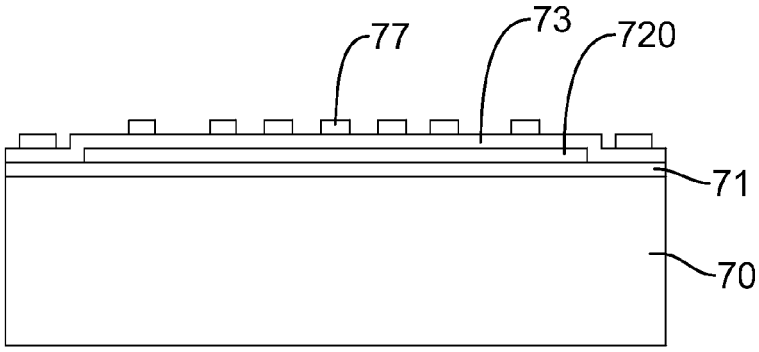
Figure 6J:
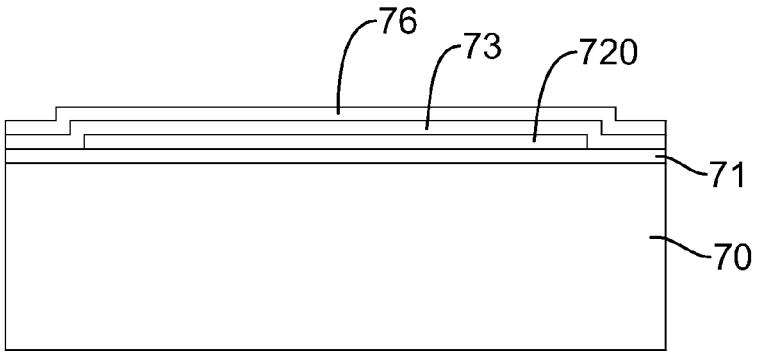
Figure 6K:
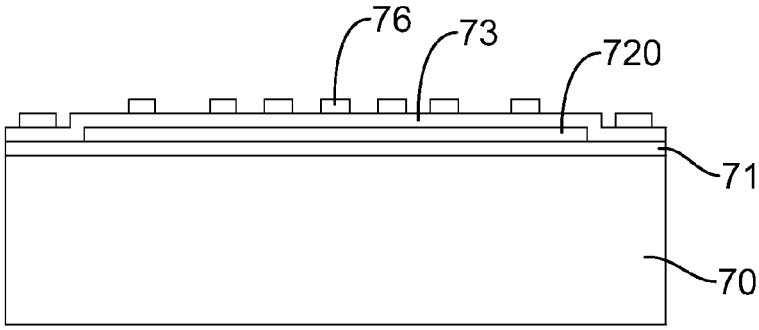
Figure 6L:
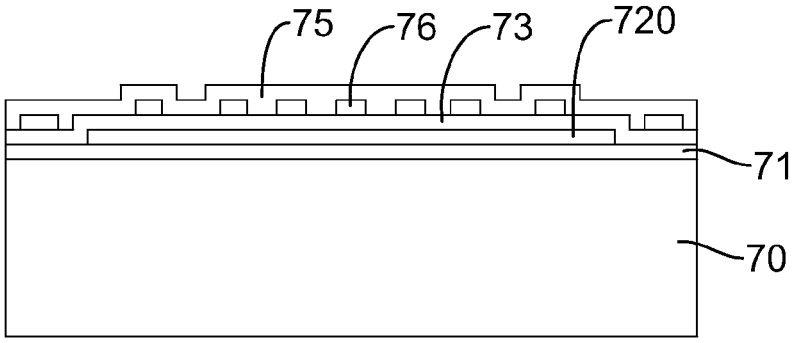
Figure 6M:
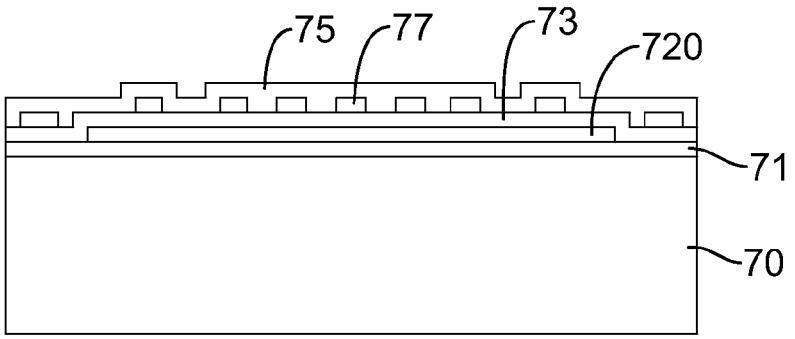

In the second embodiment, a first step is to provide a base. With reference to FIGS. 6A-6D, a beginning step is to provide a substrate 70. The substrate 70 has a top and a first insulation layer 71 formed on the top. With reference to FIG. 6B, a next step is to form a sacrificial layer 72 on the first insulation layer 71. With reference to FIG. 6C, a next step is to partially remove the sacrificial layer 72 via a photolithography procedure to form a cavity determination layer 720 by the sacrificial layer 72 remaining on the first insulation layer 71. With reference to FIG. 6D, a next step is to form a second insulation layer 73 on the first insulation layer 71 to cover the cavity determination layer 720. As a result, the base is formed.

A second step is to form a metallic silicide on the base. The metallic silicide manufacturing process is the same as that of the first embodiment. With reference to FIGS. 6E-6I, a first method to form the metallic silicide is to form a silicon film 75 on the second insulation layer 73 at first and then is to form a metal film 76 on the silicon film 75. A next step is to anneal the base at an annealing temperature to form the metallic silicide 77. The annealing temperature approximates to 800° C. A final step is to partially remove the metal film 76 that has not reacted with the silicon film 75 yet. With reference to FIGS. 6J-6M, a second method to form the metallic silicide is to form a metal film 76 on the second insulation layer 73 at first and then is to form a silicon film 75 on the metal film 76. A next step is to anneal the base at an annealing temperature to form the metallic silicide 77. The annealing temperature approximates to 800° C. A final step is to partially remove the silicon film 75 that has not reacted with the metal film 76 yet. Such metallic silicide 77 is regarded as the conductive wire 103 illustrated in FIG. 1.

Figure 6N:
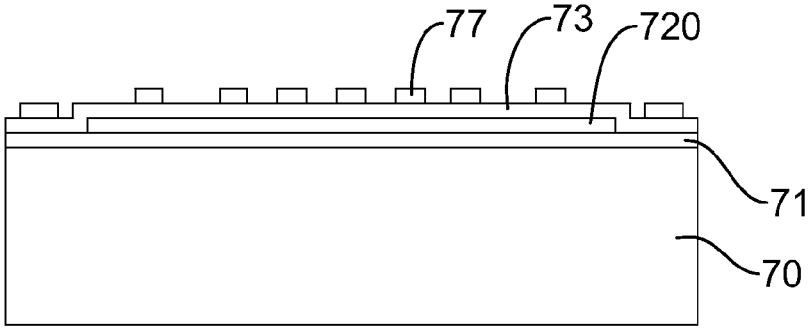

With reference to FIG. 6N, a third step is to anneal the base at an annealing temperature to stabilize the metallic silicide if necessary. The annealing temperature approximates to 800° C.

Figure 6O:
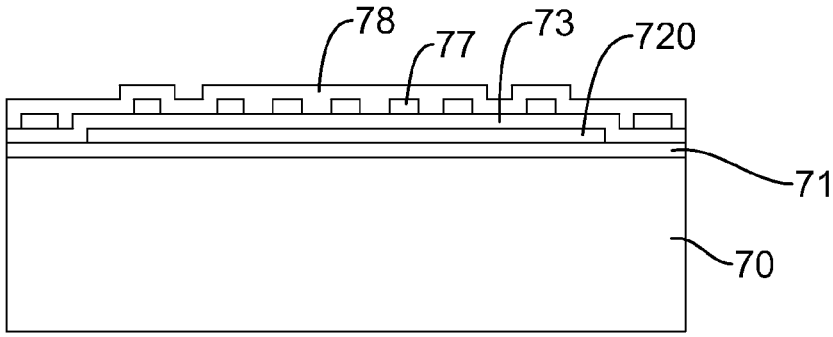

With reference to FIG. 6O, a fourth step is to form an outer insulation layer 78 on the second insulation layer 73 to cover the metallic silicide 77.

Figure 6P:
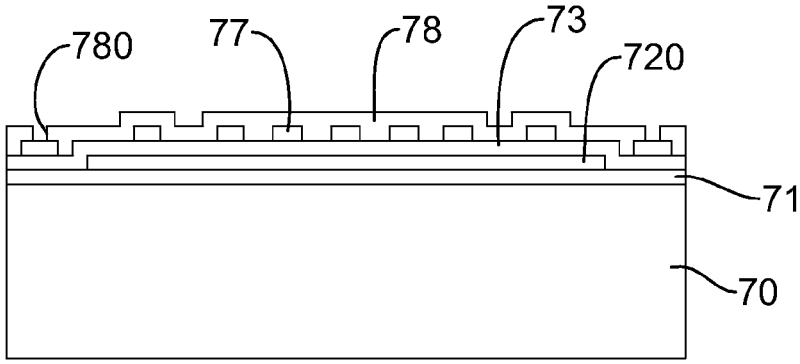

With reference to FIG. 6P, a fifth step is to define multiple electrode formation areas on the outer insulation layer 78 and then to form multiple holes 780 through the outer insulation layer 78 at the electrode formation areas. The metallic silicide 77 is partially exposed in the holes 780.

Figure 6Q:
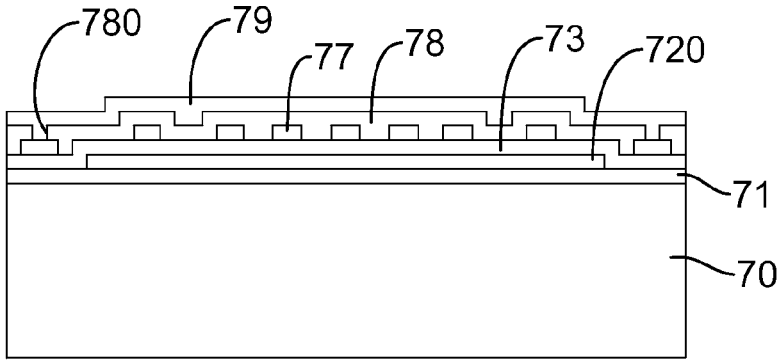

With reference to FIG. 6Q, a sixth step is to form a conducting layer 79 on the outer insulation layer 78. The conducting layer 79 extends into the holes 780 to electrically connect to the metallic silicide 77.

The fourth, the fifth and the sixth steps are optional. That means that the conducting layer 79 can be directly formed on the second insulation layer 73, wherein the conducting layer 79 covers the metallic silicide 77 and is applied to define the electrode formation areas.

Figure 6R:
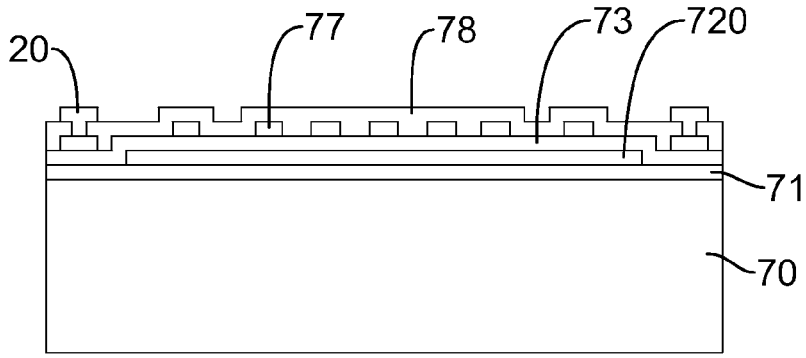

With reference to FIG. 6R, a seventh step is to partially remove the conducting layer to maintain a part of the conducting layer in the electrode formation areas. The remaining conducting layer forms multiple electrodes 20.

Figure 6S:
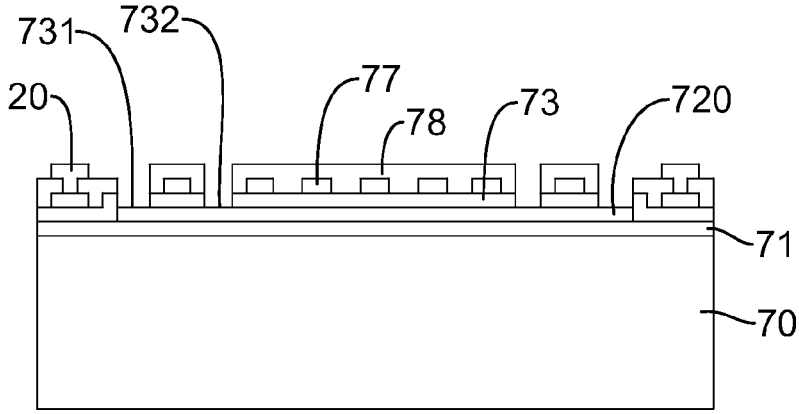

With reference to FIG. 6S, an eighth step is to form multiple etching windows 731, 732 on the base. A beginning step is to define a first etching window region and a second etching window region on the second insulation layer 73. Then the etching window regions of the second insulation layer 73 are partially removed via a photolithography procedure and an etching procedure to form a first etching window 731 and a second etching window 732. The cavity determination layer 720 is partially exposed in the first etching window 731 and the second etching window 732. A surrounding region is defined around the etching windows 731, 732.

Figure 6T:
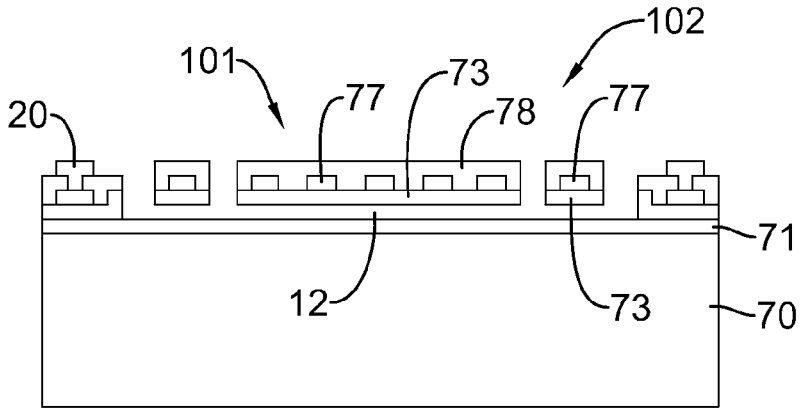

With reference to FIG. 6T, a ninth step is to etch the cavity determination layer 720 through the first etching window 731 and the second etching window 732 to form a cavity 12. Because the materials of the first insulation layer 71, the second insulation layer 73 and the cavity determination layer 720 are different, the etching rate of the cavity determination layer 720 is faster than that of the first insulation layer 71 and the second insulation layer 73. An etch solution etches the cavity determination layer 720 to form the cavity 12. As a result, such second embodiment is accomplished.

The body in the second embodiment comprises the substrate 70, the first insulation layer 71 and the second insulation layer 73. The second insulation layer 73 above the cavity 12 is regarded as the suspended part 101 and the connection parts 102. The suspended part 101 and the connection parts 102 are above the cavity 12. The connection parts 102 extend from the surrounding region and are respectively connected to the suspended part 101 to support the suspended part 101 above the cavity 12. According to the steps mentioned above, the second embodiment in accordance with the present invention is feasible.

Figure 7A:
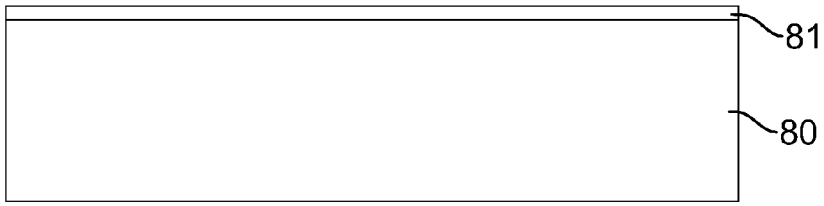
FIGS. 7A-7K are manufacturing steps of the third embodiment.

In the third embodiment, a first step is to provide a base. The base can be a <100>-orientated monocrystalline silicon substrate. With reference to FIG. 7A, the base is a silicon substrate 80 and has a metal film 81 on a top.

Figure 7B:
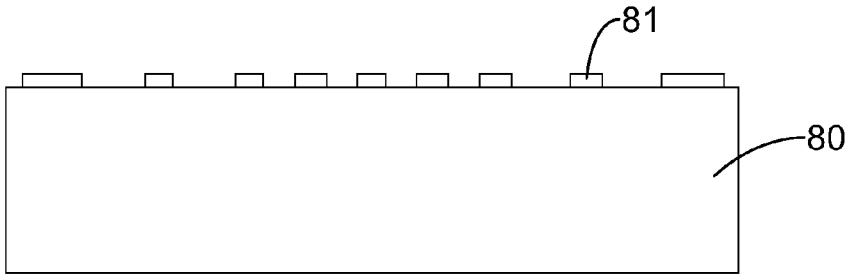
Figure 7C:
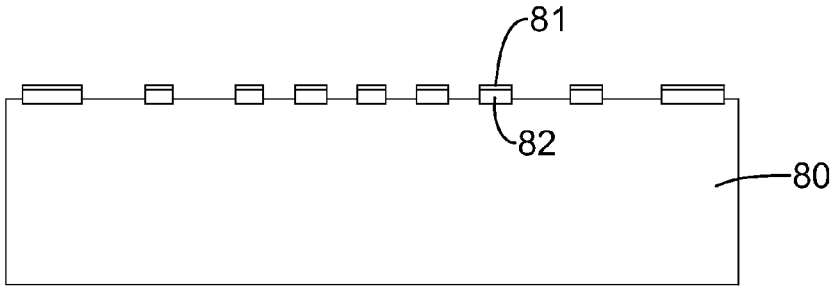

With reference to FIG. 7B, a second step is to make the metal film 81 serpentine as the conductive wire 103 illustrated in FIG. 1 via a photolithography procedure and an etching procedure With reference to FIG. 7C, a third step is to anneal the base at an annealing temperature. The annealing temperature approximates to 800° C. The metal elements of the metal film 81 diffuse into the silicon substrate 80 to form a metallic silicide 82. The metallic silicide 82 forms the conductive wire 103.

Figure 7D:
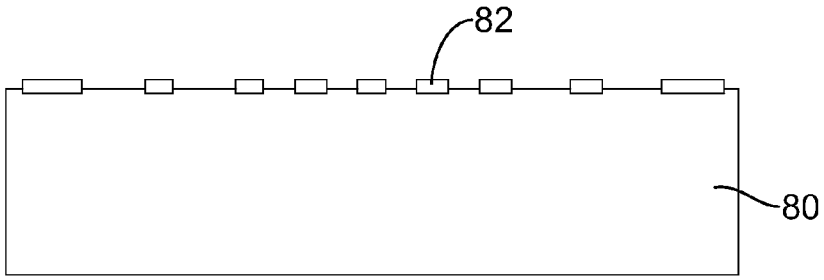

With reference to FIG. 7D, a fourth step is to partially remove the metal film which has not reacted with the silicon substrate 80 yet.

Figure 7E:
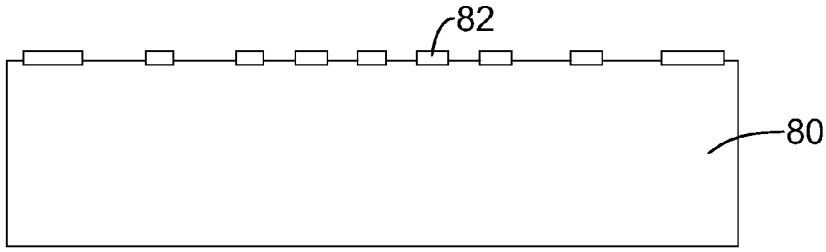

With reference to FIG. 7E, a fifth step is to anneal the base at an annealing temperature approximating to 800° C. to stabilize the metallic silicide 82 if necessary.

Figure 7F:
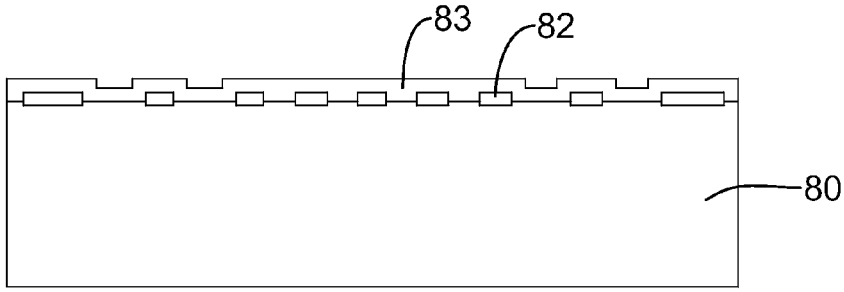

With reference to FIG. 7F, a sixth step is to form an outer insulation layer 83 on the silicon substrate 80 to cover the metallic silicide 82.

Figure 7G:
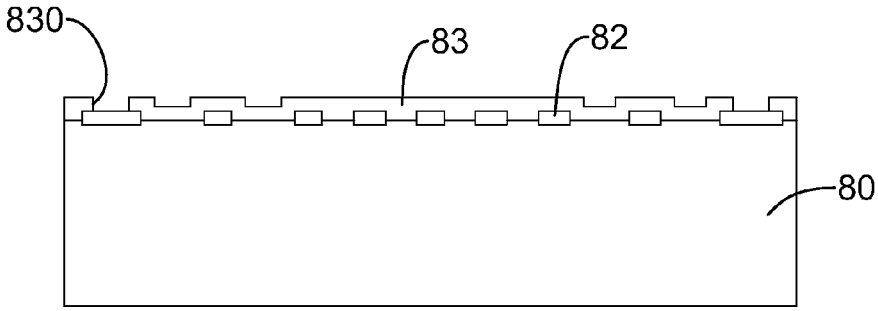

With reference to FIG. 7G, a seventh step is to define multiple electrode formation areas on the outer insulation layer 83 and then to form multiple holes 830 through the outer insulation layer 83 at the electrode formation areas. The metallic silicide 82 is partially exposed in the holes 830.

Figure 7H:
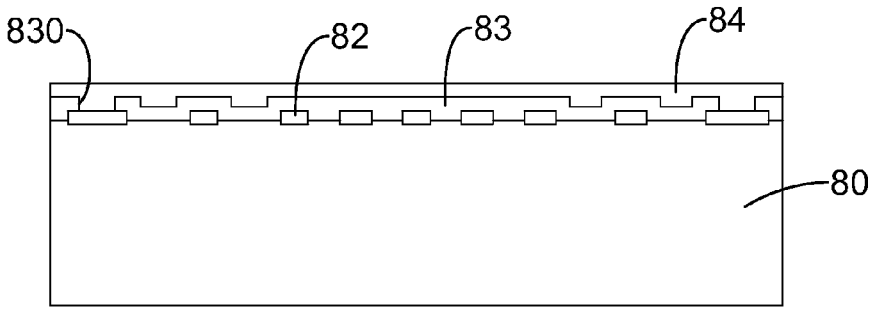

With reference to FIG. 7H, an eighth step is to form a conducting layer 84 on the outer insulation layer 83. The conducting layer 84 extends into the holes 830 to electrically connect to the metallic silicide 82.

Figure 7I:
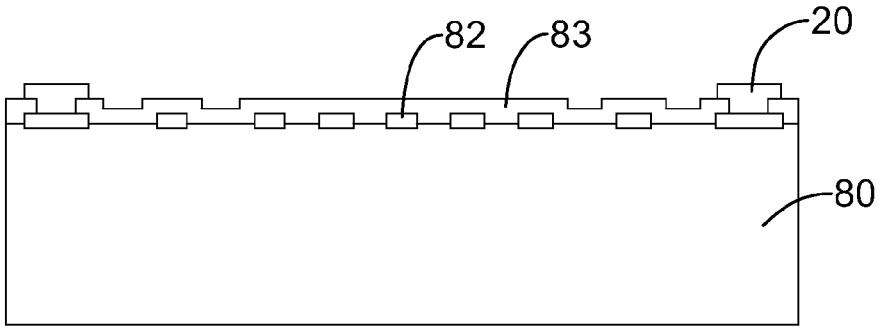

With reference to FIG. 7I, a ninth step is to partially remove the conducting layer except the electrode formation areas. A remaining conducting layer forms multiple electrodes 20.

Figure 7J:
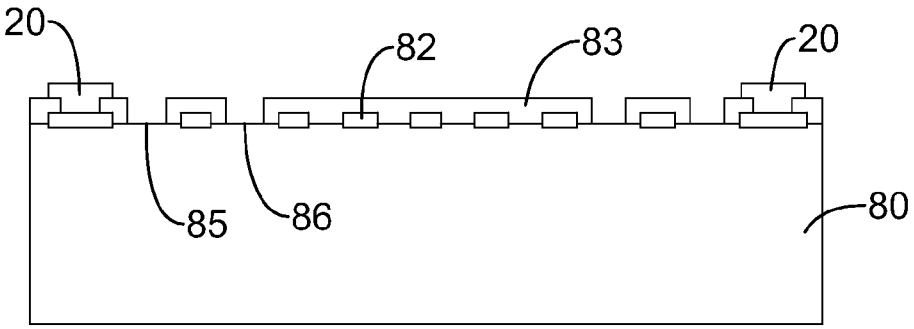

With reference to FIG. 7J, a tenth step is to form multiple etching windows 85, 86 on the base. A beginning step is to define a first etching window region and a second etching window region on the outer insulation layer 83. Then the etching window regions of the outer insulation layer 83 are partially removed via a photolithography procedure and an etching procedure to form a first etching window 85 and a second etching window 86. The silicon substrate 80 is partially exposed in the first etching window 85 and the second etching window 86. A surrounding region is defined around the etching windows 85, 86.

Figure 7K:
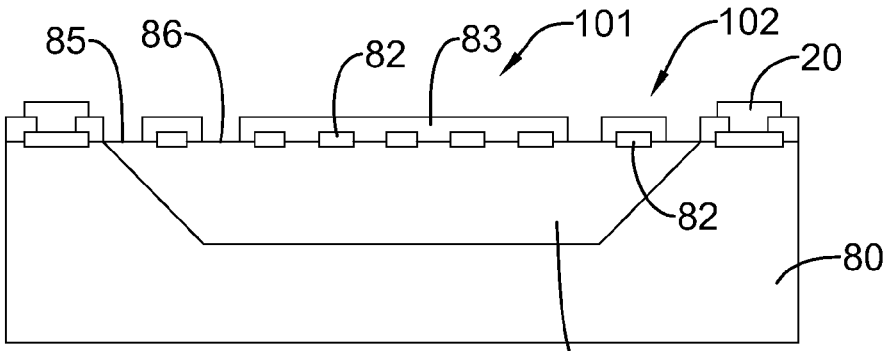

With reference to FIG. 7K, an eleventh step is to etch the silicon substrate 80 to form a cavity 12. Because the materials of the silicon substrate 80, the outer insulation layer 83 and the metallic silicide 82 are different, the etching rate of the silicon substrate 80 is faster than that of the outer insulation layer 83 and the metallic silicide 82. An etch solution internally etches downward the silicon substrate 80 to form the cavity 12 based on the <100>-oriented characteristic. As a result, such third embodiment is feasible.

Figure 8:
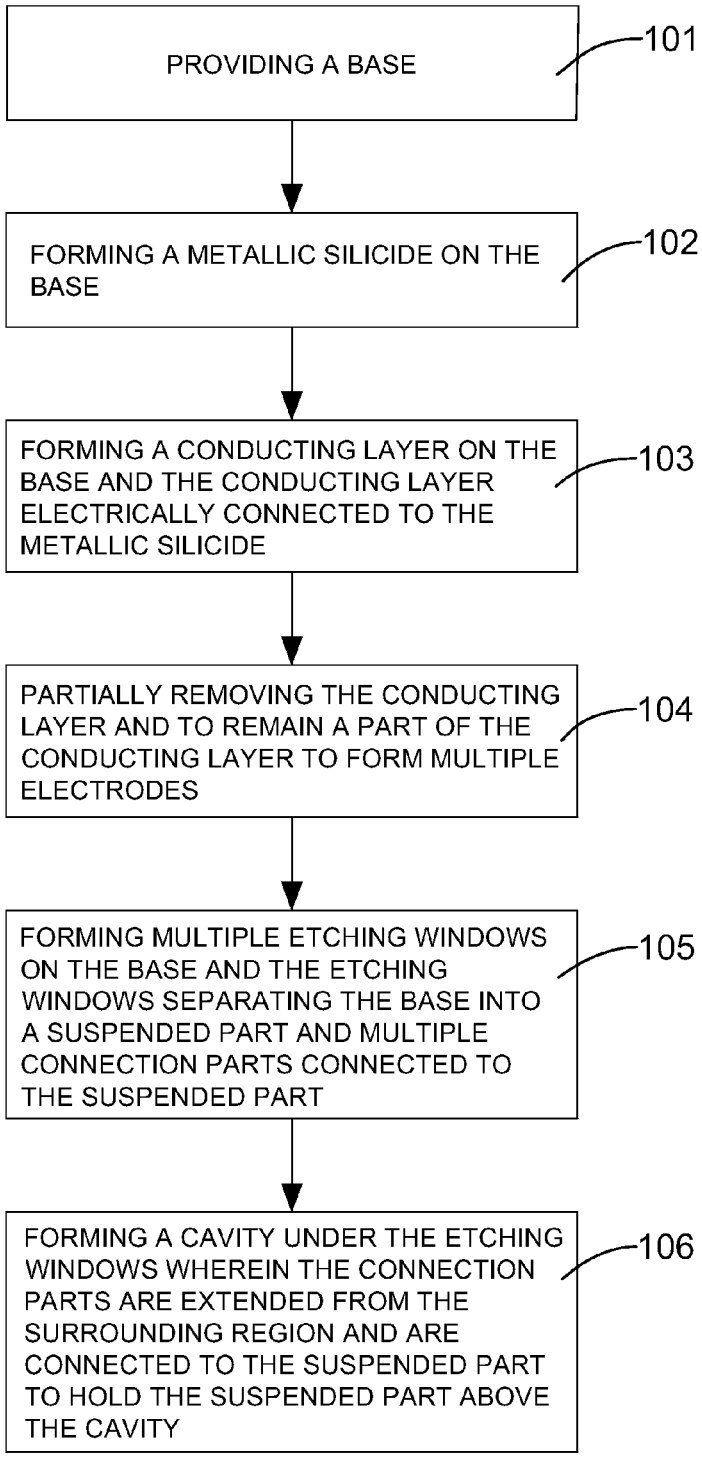
FIG. 8 is a flow chart of the manufacturing method in accordance with the present invention.

With reference to FIG. 8, the manufacturing process in accordance with the present invention mainly has the following steps:

A first step is to provide a base (101).

A second step is to form a metallic silicide on the base, wherein the metallic silicide is serpentine (102).

A third step is to form a conducting layer on the base. The conducting layer covers and is electrically connected to the metallic silicide (103).

A fourth step is to partially remove the conducting layer to maintain a part of the conducting layer. The remaining conducting layer forms multiple electrodes electrically connected to the metallic silicide (104).

A fifth step is to form multiple etching windows on the base. A surrounding region is defined around the etching windows. The etching windows separate the base into a suspended part and multiple connection parts connected to the suspended part (105).

A final step is to etch the base to form a cavity under the etching windows, the suspended part and the connection parts. The connection parts extend from the surrounding region and are connected to the suspended part to support the suspended part above the cavity (106). Then a resistive thermal sensor in accordance with the present invention is accomplished.

The metallic silicide has low resistance and high conductivity. The substrate, such as a monocrystalline silicon substrate, and the metal elements, such as titanium, cobalt, nickel, tantalum, tungsten or molybdenum, are compatible for common CMOS manufacturing process regardless of a vanadium oxide and an amorphous silicon that are not compatible for common CMOS manufacturing process. Additional manufacturing processes are not necessary for the present invention. Therefore, the cost for manufacturing the resistive thermal sensor in accordance with the present invention decreases. Moreover, when the resistive thermal sensor is activated, flicker noises generated from the metallic materials are lower.

The temperature coefficient of resistance of the titanium, cobalt, nickel, tantalum, tungsten and molybdenum elements is positive and is almost 0.39%/K. Such metal elements have better stability at high temperature.

What is claimed is:

1. A metallic silicide resistive thermal sensor comprising:
- a body comprising:
  - a central region;
  - a surrounding region;
  - multiple etching windows formed on the central region; and
  - a cavity formed under the etching windows and the central region and communicating with the etching windows; the etching windows separating the body into:
    - a suspended part formed above the cavity; and
    - multiple connection parts formed above the cavity, extending from the surrounding region and connected to the suspended part to support the suspended part above the cavity;
- a conductive wire formed on the suspended part and the connection parts, made of metallic silicide and has multiple ends, wherein the conductive wire is serpentine; and multiple electrodes formed on the body and electrically and respectively connected to the ends of the conductive wire.

2. The resistive thermal sensor as claimed in claim 1, the body comprising:

a substrate, wherein the cavity is formed in the substrate; and an insulation layer formed on the substrate, wherein the etching windows are formed in the insulation layer;

wherein the conductive wire is formed on the insulation layer.

3. The resistive thermal sensor as claimed in claim 2 further comprising an outer insulation layer formed on the body, wherein:

the outer insulation layer covers the suspended part and the connection parts and has multiple holes corresponding to the electrodes; and the electrodes are formed on the outer insulation layer and respectively extend into the holes to electrically connect to the conductive wire.

4. The resistive thermal sensor as claimed in claim 1, the body comprising:

a substrate;

a first insulation layer formed on the substrate;

a second insulation layer formed on the first insulation layer, wherein the etching windows are formed in the second insulation layer and the cavity is formed between the first insulation layer and the second insulation layer;

wherein the conductive wire is formed on the second insulation layer.

5. The resistive thermal sensor as claimed in claim 4 further comprising an outer insulation layer formed on the second insulation layer, wherein:

the outer insulation layer covers the suspended part and the connection parts and has multiple holes corresponding to the electrodes; and the electrodes are formed on the outer insulation layer and respectively extend into the holes to electrically connect to the conductive wire.

6. The resistive thermal sensor as claimed in claim 1 further comprising an outer insulation layer, wherein the body is a substrate;

the etching windows are formed on the substrate;

the cavity is formed in the substrate;

the suspended part and the connection part is the conductive wire;

the outer insulation layer is formed on the substrate and covers the suspended part and the connection parts and has multiple holes corresponding to the electrodes; and the electrodes are formed on the outer insulation layer and respectively extend into the holes to electrically connect to the conductive wire.

7. The resistive thermal sensor as claimed in claim 1, wherein the conductive wire can be titanium silicide, cobalt silicide, nickel silicide, tantalum silicide, tungsten silicide or molybdenum silicide.

8. The resistive thermal sensor as claimed in claim 1, wherein a thickness of the conductive wire is between 10 nm and 500 nm.

9. The resistive thermal sensor as claimed in claim 1, wherein a sheet resistance of the conductive wire is below 20 ohm/sq. and a temperature coefficient of resistance of the conductive wire is positive.

10. The resistive thermal sensor as claimed in claim 1, wherein the multiple etching windows comprise:

a first etching window having a first groove having two opposite terminals;

a second groove extending from one terminal; and a third groove extending from another terminal;

the first, the second and the third groove forming a C shape; and a second etching window having a first groove having two opposite terminals;

a second groove extending from one terminal; and a third groove extending from another terminal;

the first, the second and the third groove forming a C shape;

the suspended part enclosed within the first etching window and the second etching window; and the connection parts respectively formed between the second grooves of the first etching window and the second etching window and between the third grooves of the first etching window and the second etching window.

11. A method for manufacturing a metallic silicide resistive thermal sensor comprising the following steps:

providing a base;

forming a metallic silicide on the base, wherein the metallic silicide is serpentine;

forming a conducting layer on the base and the conducting layer covering and electrically connected to the metallic silicide;

partially removing the conducting layer to maintain a part of the conducting layer to form multiple electrodes electrically connected to the metallic silicide;

forming multiple etching windows on the base, wherein a surrounding region is defined around the etching windows, and the etching windows separate the base into a suspended part and multiple connection parts connected to the suspended part; and forming a cavity under the etching windows, the suspended part and the connection parts, wherein the connection parts extend from the surrounding region and are connected to the suspended part to support the suspended part above the cavity.

12. The method as claimed in claim 11, wherein the base comprises a substrate and an insulation layer formed on the substrate; and the metallic silicide is made by the following steps:

forming a silicon film on the insulation layer;

making the silicon film serpentine;

forming a metal film on the insulation layer to cover the silicon film;

annealing the base at an annealing temperature to make the metal film diffuse into the silicon film, wherein the silicon film turns into the metallic silicide and the metallic silicide forms a conductive wire and multiple conductive wire; and removing the metal film that has not reacted with the silicon film yet.

13. The method as claimed in claim 12 further comprising the following steps:

forming an outer insulation layer on the insulation layer after forming the metallic silicide to cover the metallic silicide;

defining multiple electrode formation areas on the outer insulation layer;

forming multiple holes through the outer insulation layer at the electrode formation areas, wherein the metallic silicide is partially exposed in the holes; and forming the conducting layer on the outer insulation layer, wherein the conducting layer extends into the holes to electrically connect to the metallic silicide.

14. The method as claimed in claim 11, wherein the base is manufactured by the following steps:

providing a substrate having a top and a first insulation layer formed on the top;

forming a sacrificial layer on the first insulation layer;

partially removing the sacrificial layer to form a cavity determination layer by the sacrificial layer remaining on the first insulation layer; and forming a second insulation layer on the first insulation layer to cover the cavity determination layer; and the cavity is formed by etching the cavity determination layer through the etching windows, and the etching windows are formed in the second insulation layer.

15. The method as claimed in claim 14, wherein the metallic silicide is manufactured by the following steps:

forming a silicon film on the second insulation layer;

making the silicon film serpentine;

forming a metal film on the second insulation layer to cover the silicon film;

annealing the base at an annealing temperature to make the metal film diffuse into the silicon film, wherein the silicon film turns into the metallic silicide and the metallic silicide forms a conductive wire and multiple conductive wire; and removing the metal film that has not reacted with the silicon film yet.

16. The method as claimed in claim 14 further comprising the following steps:

forming an outer insulation layer on the second insulation layer after forming the metallic silicide to cover the metallic silicide;

defining multiple electrode formation areas on the outer insulation layer;

forming multiple holes through the outer insulation layer at the electrode formation areas, wherein the metallic silicide is partially exposed in the holes; and forming the conducting layer on the outer insulation layer, wherein the conducting layer extends into the holes to electrically connect to the metallic silicide.

17. The method as claimed in claim 15 further comprising the following steps:

forming an outer insulation layer on the second insulation layer after forming the metallic silicide to cover the metallic silicide;

defining multiple electrode formation areas on the outer insulation layer;

forming multiple holes through the outer insulation layer at the electrode formation areas, wherein the metallic silicide is partially exposed in the holes; and forming the conducting layer on the outer insulation layer, wherein the conducting layer extends into the holes to electrically connect to the metallic silicide.

18. The method as claimed in claim 11 further comprising the following steps:

forming an outer insulation layer on the base after forming the metallic silicide to cover the metallic silicide, wherein the base is a silicon substrate;

defining multiple electrode formation areas on the outer insulation layer;

forming multiple holes through the outer insulation layer at the electrode formation areas, wherein the metallic silicide is partially exposed in the holes; and forming the conducting layer on the outer insulation layer, wherein the conducting layer extends into the holes to electrically connect to the metallic silicide.

19. The method as claimed in claim 18, wherein the metallic silicide is manufactured by the following steps:

forming a metal film on the base;

making the metal film serpentine;

annealing the base at an annealing temperature to make the metal film diffuse into the base to form the metallic silicide, wherein the metallic silicide forms a conductive wire and multiple conductive wire; and removing the metal film that has not reacted with the base yet.

20. The method as claimed in claim 19, wherein the annealing temperature approximates to 800° C.

* * * * *